US008997477B2

(12) United States Patent
Heo et al.

(10) Patent No.: US 8,997,477 B2
(45) Date of Patent: Apr. 7, 2015

(54) APPARATUS FOR CONTROLLING RAISE SPEED OF WORKING MACHINE FOR HEAVY EQUIPMENT

(75) Inventors: Chan Heo, Seoul (KR); Hyun Gie Koh, Incheon (KR)

(73) Assignee: Doosan Corporation, Seoul (KR)

( * ) Notice: Subject to any disclaimer, the term of this patent is extended or adjusted under 35 U.S.C. 154(b) by 393 days.

(21) Appl. No.: 13/698,432

(22) PCT Filed: May 19, 2011

(86) PCT No.: PCT/KR2011/003698

§ 371 (c)(1),
(2), (4) Date: Nov. 16, 2012

(87) PCT Pub. No.: WO2011/145892

PCT Pub. Date: Nov. 24, 2011

(65) Prior Publication Data

US 2013/0055704 A1 Mar. 7, 2013

(30) Foreign Application Priority Data

May 19, 2010 (KR) ..... 10-2010-0046766

(51) Int. Cl.

| | |
|---|---|
| ***F15B 11/16*** | (2006.01) |
| ***B66F 9/22*** | (2006.01) |
| ***F02D 29/04*** | (2006.01) |

(52) U.S. Cl.

CPC ..... *F15B 11/166* (2013.01); *B66F 9/22* (2013.01); *F02D 29/04* (2013.01); (Continued)

(58) Field of Classification Search

CPC ..... F15B 11/166; F15B 2211/665; F15B 2211/20576; F15B 2211/329; F15B 2211/359; F15B 2211/2053; F15B 2211/6654; F02D 29/04; B66F 9/22

See application file for complete search history.

(56) References Cited

U.S. PATENT DOCUMENTS

| | | | | |
|---|---|---|---|---|
| 5,176,504 | A * | 1/1993 | Moriya et al. | 417/216 |
| 6,209,321 | B1 * | 4/2001 | Ikari | 60/422 |

(Continued)

FOREIGN PATENT DOCUMENTS

| | | |
|---|---|---|
| JP | 10265195 | 6/1998 |
| JP | 2002-068696 | 8/2002 |
| JP | 2006-144820 | 8/2006 |
| JP | 2009-256094 | 5/2009 |

OTHER PUBLICATIONS

Search Report dated Feb. 6, 2012 and written in Korean for International Application No. PCT/KR2011/003698, filed May 19, 2011, 2 pages.

*Primary Examiner* — Thomas E Lazo

(74) *Attorney, Agent, or Firm* — John D. Veldhuis-Kroeze; Westman, Champlin & Koehler, P.A.

(57) ABSTRACT

The present disclosure relates to an apparatus for controlling a raise speed of a working machine for heavy equipment that includes first and second pumps, a main control valve unit that includes two lift cylinder operation units connected with the first and second pumps and operating two lift cylinders and one tilt cylinder operation unit operating two tilt cylinders, a priority valve that is provided in a working fluid line between the second pump and the main control valve unit, and a lift lever that includes a remote control valve connected with the two lift cylinder operation units through a pilot oil line, respectively, and controlling the two lift cylinders through the two lift cylinder operation units, in which a valve control unit, which electrically controls the flow of pilot oil in proportion to the RPM of an engine to allow or stop the working fluid flowing from any one of the two lift cylinder operation units to the two lift cylinders, is disposed in any one of two pilot oil lines between the two lift cylinder operation units and the remote control valve of the lift lever.

2 Claims, 2 Drawing Sheets

(52) U.S. Cl.

CPC ..... *F15B 2211/20523* (2013.01); *F15B 2211/20576* (2013.01); *F15B 2211/30565* (2013.01); *F15B 2211/329* (2013.01); *F15B 2211/355* (2013.01); *F15B 2211/633* (2013.01); *F15B 2211/665* (2013.01); *F15B 2211/6654* (2013.01)

(56) References Cited

U.S. PATENT DOCUMENTS

| | | | | |
|---|---|---|---|---|
| 6,305,162 | B1 * | 10/2001 | Cobo et al. | 60/422 |
| 7,007,466 | B2 * | 3/2006 | Price | 60/431 |
| 8,720,629 | B2 * | 5/2014 | Sohn et al. | 180/170 |

* cited by examiner

APPARATUS FOR CONTROLLING RAISE SPEED OF WORKING MACHINE FOR HEAVY EQUIPMENT

This Application is a Section 371 National Stage Application of International Application No. PCT/KR2011/003698, filed May 19, 2011 and published, not in English, as WO2011/145892 on Nov. 24, 2011.

FIELD OF THE DISCLOSURE

The present disclosure relates to an apparatus for controlling a raise speed of a working machine mounted on heavy equipment such as a forklift truck or a wheel loader, and more particularly, to an apparatus for controlling a raise speed of a work machine for heavy equipment which can increase acceleration performance of an engine by instantaneously reducing load of a pump when a working machine (or fork carriage) is raised by pressing down an engine acceleration pedal at a low RPM of the engine, and can prevent the operation of the engine from unexpectedly stopping due to an increase in load of the pump without pressing down the engine acceleration pedal.

BACKGROUND OF THE DISCLOSURE

In general, heavy equipment, such as a forklift truck and a wheel loader, is used for work of raising or lowering a heavy object (or freight) and work of carrying an object to a desired place, and has been used throughout the industry. Briefly describing a forklift truck, the car body of the forklift truck is supported by the front driving wheels and the rear steering wheels and a mast assembly is disposed at the front. The mast assembly is disposed with the lower end rotatable about a driving shaft supporting the front driving wheels and has a mast rail vertically disposed, and a fork carriage that moves up/down along the mast rail and moves left/right is mounted on the mast rail.

FIG. 1 is a hydraulic circuit diagram of a hydraulic system of a forklift truck according to the related art.

A forklift truck according to the related art, as show in FIG. 1, includes first and second pumps 1 and 2, a priority valve 3, a main control valve unit 10, two lift cylinders 4, two tilt cylinders 5, a lift lever 6 with a remote control valve 6*a*, and a tilt lever 7 with a remote control valve 7*a*.

In this configuration, the first and second pumps 1 and 2 are operated by receiving power from an engine, the first pump 1 is connected with the port at a side of the main control valve unit 10 and the second pump is connected with the port at the other side of the main control valve unit 10 through the priority valve 3.

The priority valve 3 is operated by a pressure difference between pressure receiving portions at both sides and serves to guide pressure oil from the second pump 2 to a steering unit or the main control valve unit 10 and the steering unit.

The main control valve unit 10 includes two lift cylinder operation units 11 and 12 and one tilt cylinder operation unit 13. The two lift cylinder operation units 11 and 12 control the two lift cylinders 4 that move the fork carriage (not shown) up/down along the mast rail of the mast assembly and the tilt cylinder operation unit 13 controls the two tilt cylinders 5 that tilt the mast assembly forward/rearward with respect to the forklift truck.

The lift cylinders 4 are controlled by the lift cylinder operation units 11 and 12 of the main control valve unit 10 by the lift lever 6 in a forklift truck cabin and the tilt cylinders 5 are controlled through the tilt cylinder operation unit 13 of the main control valve unit 10 by the tilt lever 7 in the cabin.

However, when the forklift truck according to the related art lifts a working machine (or fork carriage) for raising or lowering a heavy object (or freight), the two lift cylinder operation units 11 and 12 of the main control valve unit 10 are opened by pilot pressure of the remote control valve 6*a* controlled by the lift lever 6 regardless of the RPM of the engine and the entire amount of oil supplied from both the first and second pumps 1 and 2 is supplied to the two lift cylinders 4 through the two lift cylinder operation units 11 and 12.

That is, in the forklift truck according to the related art, since the amount of oil supplied from both the first and second pumps 1 and 2 is supplied to the two lift cylinders 4 through the two lift cylinder operation units 11 and 12 even if the RPM of the engine is low, the load exerted in both the first and second pumps 1 and 2 through the two lift cylinders 11 and 12 may be applied to the engine.

When the engine acceleration pedal is pressed down and the fork carriage (not shown) is raised, with the load applied to the engine through the two pumps at low RPM of the engine, it takes long time for the RPM of the engine to reach the maximum level in the forklift truck, such that the work performance is deteriorated and the worker feels inconvenience.

On the other hand, when the engine acceleration pedal is not pressed down at low RPM of the engine and the fork carriage (not shown) with a large load mounted is raised, the operation of the engine is likely to stop when the load exerted in both the first and second pumps 1 and 2 is larger than the corresponding output torque of the engine.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

Accordingly, the present disclosure is contrived to solve the above-mentioned problems, and the object of the present disclosure is to provide an apparatus for controlling a raise speed of a working machine for heavy equipment which can rapidly lift a working machine (or fork carriage) with relatively large load at low RPM of an engine.

Another object of the present disclosure is to provide an apparatus for controlling a raise speed of a working machine for heavy equipment which makes it possible to prevent the operation of an engine from unexpectedly stopping when raising a working machine (or fork carriage) with relatively large load at low RPM of an engine.

In order to achieve the object, the present disclosure provides an apparatus for controlling a raise speed of a working machine for heavy equipment that includes first and second pumps, a main control valve unit that includes two lift cylinder operation units connected with the first and second pumps and operating two lift cylinders and one tilt cylinder operation unit operating two tilt cylinders, a priority valve that is provided in a working fluid line between the second pump and the main control valve unit, and a lift lever that includes a remote control valve connected with the two lift cylinder operation units through a pilot oil line, respectively, and controlling the two lift cylinders through the two lift cylinder operation units, in which a valve control unit, which electrically controls the flow of pilot oil in proportion to the RPM of an engine to allow or stop the working fluid flowing from any one of the two lift cylinder operation units to the two lift cylinders, is disposed in any one of two pilot oil lines between the two lift cylinder operation units and the remote control valve of the lift lever.

Further, the present disclosure further provides the following detailed exemplary embodiment for an exemplary embodiment of the present disclosure.

According to an exemplary embodiment of the present disclosure, the valve control unit is composed of an electric proportional reducing valve that is provided in a pilot oil line to connect of disconnect the pilot oil line between the lift cylinder operation unit and the remote control valve of the lift lever; and a controller that electrically controls the amount of opening of the electric proportional reducing valve in proportion to RPM of an engine.

DETAILED DESCRIPTION

Hereinafter, an exemplary embodiment of an apparatus for controlling a raise speed of a working machine for heavy equipment according to the present disclosure is described with reference to FIG. 2.

Figure 1:
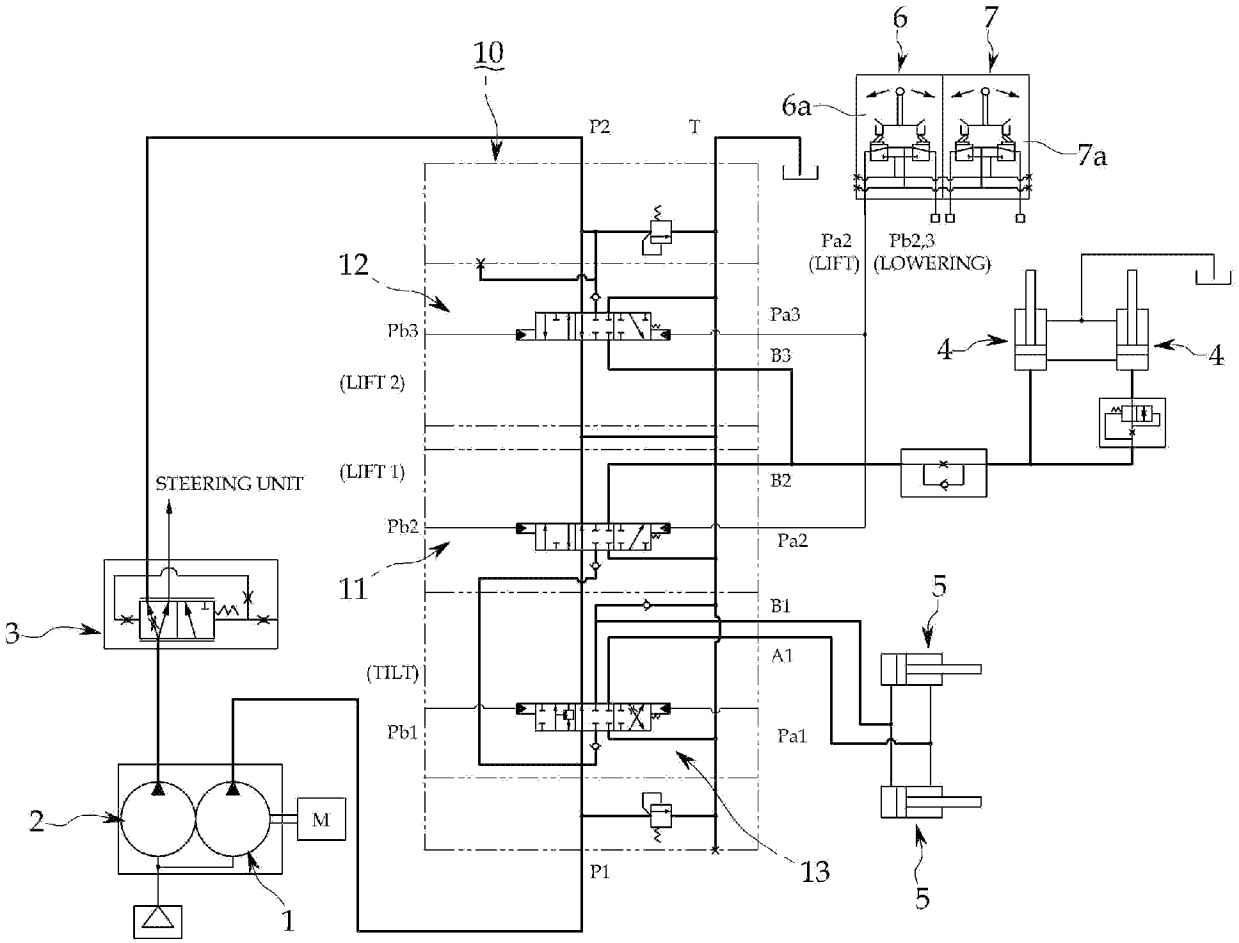
FIG. 1 is a hydraulic circuit diagram of a hydraulic system of a forklift truck according to the related art.
Figure 2:
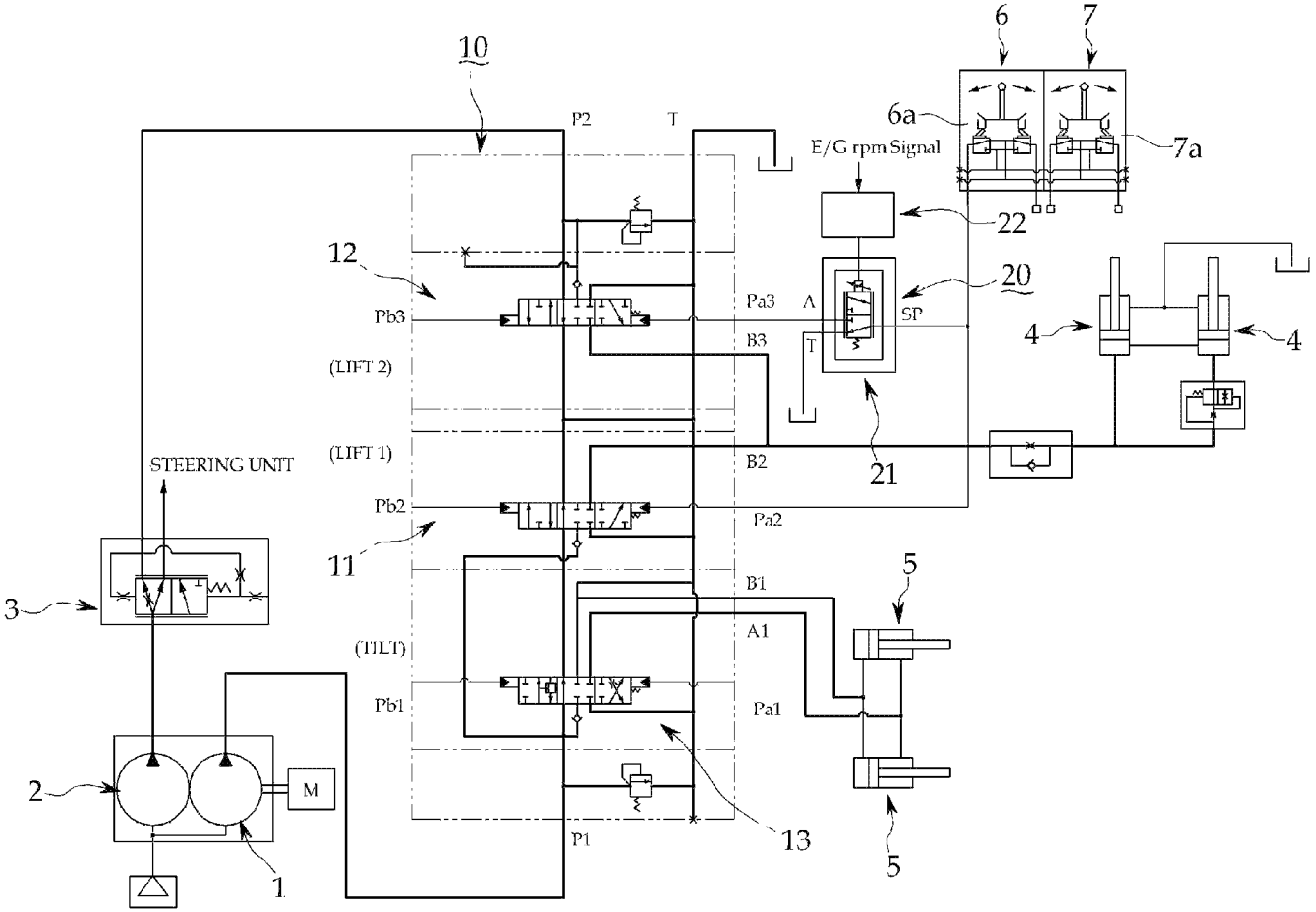
FIG. 2 is a hydraulic circuit diagram of an apparatus for controlling a raise speed of a working machine for heavy equipment according to the present disclosure.

FIG. 2 is a hydraulic circuit diagram of an apparatus for controlling a raise speed of a working machine for heavy equipment according to the present disclosure.

An apparatus for controlling a raise speed of a working machine for heavy equipment, as shown in FIG. 2, includes first and second pumps 1 and 2, a main control valve unit 10 that includes two lift cylinder operation units 11 and 12 connected with the first and second pumps and operating two lift cylinders 4 and one tilt cylinder operation unit 13 operating two tilt cylinders 5, a priority valve 3 that is provided in a working fluid line between the second pump 2 and the main control valve unit 10, and a lift lever 6 that includes a remote control valve 6*a* connected with the two lift cylinder operation units 11 and 12 through a pilot oil line, respectively, and controlling the two lift cylinders 4 through the two lift cylinder operation units 11 and 12. Further, a valve control unit 20, which electrically controls the flow of pilot oil in proportion to the RPM of an engine to allow or stop the working fluid flowing from any one of the two lift cylinder operation units 11 and 12 to the two lift cylinders 4, is disposed in any one of two pilot oil lines between the two lift cylinder operation units 11 and 12 and the remote control valve 6*a* of the lift lever 6.

In the apparatus for controlling a lift speed of a working machine for heavy equipment according to the present disclosure having the configuration described above, even if a large load is exerted in the working machine (or fork carriage) and the driver presses down an engine acceleration pedal (not shown) after moving the lift lever 6 to a raising position at low RPM of the engine, the valve control unit 20 can block any one of the two pilot oil lines between the two lift cylinder operation units 11 and 12 and the remote control valve 6*a* of the lift lever 6 by operating in proportion to the RPM of the engine, thereby not generating load in the engine simultaneously through both the first and second pumps 1 and 2.

Therefore, in an engine of heavy equipment equipped with the apparatus for controlling a raise speed of a working machine, the valve control unit 20 proportionately increases the amount of opening of the pilot oil line where the valve control unit is disposed, in proportion to the RPM of the engine, and thus when the pilot oil pressure of the pilot oil line sufficiently increases, the pressure oil supplied from the other one pump in an idling state, that is, the second pump 2 in the exemplary embodiment is guided to the two lift cylinders 4 to meet the pressure oil supplied from the first pump 1 through the lift cylinder operation unit 12, such that it is possible to rapidly lift the working machine (or fork carriage) (see FIG. 2).

Meanwhile, In the apparatus for controlling a lift speed of a working machine for heavy equipment according to the present disclosure having the configuration described above, even if a large load is exerted in the working machine (or fork carriage) and the driver lifts the working machine (or fork carriage) by using the lift lever 6 without pressing down the engine acceleration pedal at low RPM of the engine, the valve control unit 20 can block any one of the two pilot oil lines between the two lift cylinder operation units 11 and 12 and the remote control valve 6*a* of the lift lever 6 in proportion to the RPM of the engine, thereby not generating load in the engine simultaneously through both the first and second pumps 1 and 2, and thus it is possible to preclude the operation of the engine from stopping.

Further, the apparatus for controlling a raise speed of a working machine for heavy equipment according to the present disclosure may be implemented to be more limited to the following detailed exemplary embodiment, with the basic configuration described above.

As an exemplary embodiment, the valve control unit 20 is composed of an electric proportional pressure reducing valve 21 and a controller 22. The electric proportional pressure reducing valve 21 is provided in the pilot oil line to connect of disconnect the pilot oil line between the lift cylinder operation units 11 and 12 and the remote control valve 6*a* of the lift lever 6. The controller 22 serves to electrically control the amount of opening of the electronic proportional reducing valve 21 in proportion to the RPM of the engine.

The operation of an apparatus for controlling a raise speed of a working machine of heavy equipment having the configuration described above is described with reference to FIG. 2.

When the information on the RPM of the engine is inputted from the outside, a controller 22 of the valve control unit 20 blocks or opens the working fluid line between the lift cylinder operation unit 11 or 12 and the two lift cylinders 4 by adjusting the amount of opening of the electric proportional reducing valve, by applying a predetermined corresponding amount of current to the electric proportional reducing valve 21 disposed in the pilot oil line connecting the lift cylinder operation unit 11 or 12 and the two lift cylinders 4 in proportion to the RPM of the engine.

Therefore, when a relatively large load is exerted in the working machine (or fork carriage) and the driver presses down the engine acceleration pedal after moving the lift lever 6 to the raising position at low RPM of the engine, the controller 22 instantaneously blocks the pilot oil line between the lift cylinder operation unit 12 and the remote control valve 6*a* of the lift lever 6 by using the electric proportional reducing valve in the exemplary embodiment, by applying a predetermined corresponding amount of current to the electric proportional reducing valve 21 in proportion to the RPM of the engine, and the RPM of the engine can rapidly increase until the lift cylinder operation unit is opened by the pilot oil pressure applied to the lift cylinder operation unit 12 (see FIGS. 2 and 3).

The RPM of the engine increases relatively quickly within several seconds (about 1 to 3 seconds) from a low idle state of the engine to a high idle N2 state. When the RPM of the engine increases within the short time, the lift cylinder operation unit 12 is opened by the valve control unit 20 and the pressure oil supplied from the other one pump in the idle state, that is, the second pump 2 in the exemplary embodiment meets the pressure oil supplied from the first pump 1 through the lift cylinder operation unit 12 and can be supplied to the two lift cylinders 4. Therefore, the working machine (or fork carriage) can be rapidly raised by the pressure oil supplied from both the first and second pumps 1 and 2 to the two lift cylinders 4.

Meanwhile, when a relatively large load is exerted in the working machine (or fork carriage) and the driver moves the lift lever 6 to the raising position without pressing down the engine acceleration pedal at low RPM of the engine, the controller 22 applies a predetermined corresponding amount of current to the electric proportional reducing valve 21 in proportion to the RPM of the engine, such that the pilot oil line between the lift cylinder operation unit 12 and the remote control valve 6*a* of the lift lever 6 is instantaneously blocked by the electric proportional reducing valve, and thus it is possible to preclude the operation of the engine from stopping.

The present disclosure described above is not limited to the exemplary embodiments and the accompanying drawings, and simple substitution, modification, and change within the spirit of the present disclosure are apparent to those skilled in the art.

The present disclosure makes it possible to rapidly lift a working machine (or fork carriage) with a relatively large load at low RPM of an engine or to preclude the operation of the engine from unexpectedly stopping when raising the working machine (or fork carriage) with a relatively large load at low RPM of the engine, by providing a valve control unit that stops or allows the flow of working fluid flowing to two lift cylinders from any one of two lift cylinder operation units by controlling the amount of opening of a corresponding pilot oil in two pilot oil lines between the two lift cylinder operation units and a remote control valve of a lift lever in proportion to the RPM of the engine.

The invention claimed is:

1. An apparatus for controlling a raise speed of a working machine for heavy equipment that includes:

first and second pumps;

a main control valve unit that includes two lift cylinder operation units connected with the first and second pumps and operating two lift cylinders and one tilt cylinder operation unit operating two tilt cylinders;

a priority valve that is provided in a working fluid line between the second pump and the main control valve unit; and a lift lever that includes a remote control valve connected with the two lift cylinder operation units through a pilot oil line, respectively, and controlling the two lift cylinders through the two lift cylinder operation units, the apparatus comprising:

a valve control unit that is disposed in any one of two pilot oil lines between the two lift cylinder operation units and the remote control valve of the lift lever and that electrically controls the flow of pilot oil in proportion to the RPM of an engine to allow or stop the working fluid flowing from any one of the two lift cylinder operation units to the two lift cylinders.

2. The apparatus for controlling a raise speed of a working machine for heavy equipment of claim 1, wherein the control unit includes:

an electric proportional pressure reducing valve that is provided in a pilot oil line to connect or disconnect the pilot oil line between the lift cylinder operation units and the remote control valve of the lift lever; and a controller that electrically controls the amount of opening of the electric proportional reducing valve in proportion to RPM of an engine.

* * * * *